US005548845A

United States Patent [19]

Gallup

[11] Patent Number: 5,548,845

[45] Date of Patent: Aug. 27, 1996

[54] ADJUSTABLE CLOSED-BACK CAP

[75] Inventor: James A. Gallup, Boulder, Colo.

[73] Assignee: Colorado Leisure Sportswear Corporation, Denver, Colo.

[21] Appl. No.: 534,727

[22] Filed: Sep. 27, 1995

[51] Int. Cl.[6] ..... A42B 1/22

[52] U.S. Cl. ..... 2/195.2; 2/183

[58] Field of Search ..... 2/171, 175.1, 195.1, 2/195.2, 195.3, 195.4, 183, 417, 418, 420, 181

[56] References Cited

U.S. PATENT DOCUMENTS 2,869,137 1/1959 Scherz ..... 2/183

FOREIGN PATENT DOCUMENTS 352322 7/1931 United Kingdom ..... 2/195.4

OTHER PUBLICATIONS

Enclosed written description and drawing of prior art cap produced by Michael of Chatham, England, date unknown.

*Primary Examiner*—Diana Biefeld

*Attorney, Agent, or Firm*—Robert G. Crouch; Chrisman, Bynum & Johnson

[57] ABSTRACT

An adjustable baseball-style cap with a closed-back or "fitted" look. The adjustability is provided by a fabric tunnel on the back panel of the cap which slidably receives a flexible strap attached to the cap at one end of the tunnel. A free end of the strap protrudes from the opposite end of the tunnel and engages with the cap via a releasable connector material. The cap can be selectively adjusted to sizes between 6½ and 7⅝ by adjusting the amount of the strap protruding from the tunnel.

7 Claims, 2 Drawing Sheets

ADJUSTABLE CLOSED-BACK CAP

This invention relates to headwear, specifically an improved cap closure yielding a closed-back or "fitted" look, yet allowing maximum size adjustment on the cap.

BACKGROUND OF THE INVENTION

Traditionally, baseball-style caps could be separated into two categories, adjustable and "fitted". Originally, closed-back caps were called "fitted" caps because they were manufactured to fit one and only one head size, i.e. 6⅞, 7⅛, or 7⅜, etc. These "fitted" caps only fit one head size and have no adjustment possible. This causes a sizing problem for the consumer and for the retailer. The consumer must find the style, fabric, and logo cap in exactly his head size, if he wants to buy a "fitted" cap. The retailer must stock every head size from 6½ to 7⅝ (by increments) in every style, fabric, and popular logo to satisfy the majority of his customers. This causes a big inventory problem for retailers who are typically required to order a manufacturer's minimum order per logo in each head size. The example of the Colorado Rockies and Major League Baseball is illustrative. A retail store that chooses to stock a purple Colorado Rockies "fitted" cap must order the manufacturer's minimum of twelve caps per color per head size. To cover the typical range of head sizes (6½ to 7⅝) in the standard ⅛ size increments with a fitted cap, this retail store owner would need to order 120 caps (twelve caps per each of ten head sizes between 6½ and 7⅝). Multiplying the twenty-eight Major League Baseball teams times this 120 caps per team, an inventory of 3360 caps would be necessary to adequately cover the typical headwear sizes for each team. A large number of these "fitted" caps would sit on the shelf until the exact fight head size came along with the fight team preference. This is anathema to modem retail techniques in which retailers who can increase inventory turn, and decrease allocated inventory dollars, have a far greater chance for business success.

Many types of adjustment closures on open-back caps exist in the marketplace today. They allow maximum head size adjustment with the following closure types: plastic snap, leather strap and brass buckle, fabric strap and hook and loop fastener, nylon webbing and plastic buckle. These closures do have maximum size adjustment, but do not have the look or comfort of a closed-back "fitted" cap. The closed-back "fitted" cap is popular today as the closure of choice for many reasons. Style is important to the youth of America, and they demand this closure. Licensed professional team sports retailers sell almost fifty percent "fitted" caps, many of which are turned around backwards as a fashion statement. This closed-back cap is popular because of comfort and appearance advantages. Open-back caps have an arched cutaway opening in the back of the cap across which either a plastic snap closure, leather strap and brass buckle, fabric strap and buckle, or nylon webbing and buckle are used for closure and adjustment. "Closing the back" with fabric offers support for the head, and is more comfortable than other closures. Furthermore, the continuous fabric appearance of the closed-back design rather than the cutaway opening of the open-back design is commonly considered to be more pleasing to the eye.

Further, many of the above-mentioned closures for open-back caps involve some kind of buckle attachment, and there is an inherent mechanical failure rate on buckles. In fact, the assignee of the present invention experiences a five percent failure rate with two-part brass buckles currently. Leather straps vary greatly in widths causing some closure failure, and plastic buckles can also be unreliable.

In the past few years some headwear manufacturers have provided some adjustment for closed-back "fitted" caps by making a closed-back with some minimal expansion available through the use of elastic. Unfortunately, the inherent disadvantage with elastic is the minimal expansion of elastic. For example, the Texace Pro 98 Plus cap is available in three sizes, small, medium, and large. Texace uses a four inch piece of elastic that stretches to about 4.75 inches. Thus, the medium cap will only fit head sizes 7⅛ and 7¼, thus defining the elastic stretch limit.

A cap marketed by Michael of Chatham, England, is adjustable in size and attempts to provide a closed-back "fitted" look. It is marked as Registered Design No. 901236, Patent No. 0199556. This cap features a hook and loop fastener closure with a complicated back flap folded under to simulate a closed-back or "fitted" look. It does not provide a clean look in the back, and is not user-friendly for the consumer, being cumbersome to adjust.

OBJECTS AND ADVANTAGES

Accordingly, several objects and advantages of my invention are:

(a) to provide an adjustable and comfortable closure for all head sizes between 6½ and 7⅝;

(b) to provide a closure which provides the "fitted" look that many consumers want with a closed-back cap in an adjustable cap with a wide size range;

(c) to provide a suitable closure for closed-back caps so that retailers can stock a much smaller inventory of such closed-back caps;

(d) to provide a closure so that participants in youth sports teams no longer must purchase a new twenty dollar fitted team cap as part of a uniform with each new season as the youth's head size changes;

(e) to provide a suitable closure that is a much more comfortable cap for the wearer than any of the open-back adjustable closures;

(f) to provide a suitable closure that is a much more comfortable cap for the wearer than the elastic closure on simulated "fitted" closed-back caps;

(g) to provide a suitable closure that is an improvement over other closures involving buckles which can fail to operate correctly due to mechanical parts failure, or poor operator application of the buckle; and (h) to provide a suitable closure that is an improvement over many "fitted" caps due to the fact that when they are exposed to moisture, i.e. rain or snow, they will shrink enough to no longer fit the head size they were purchased for.

Further objects and advantages of the present invention will become apparent from a consideration of the drawings and ensuing description.

SUMMARY OF THE INVENTION

To achieve the foregoing and other objects and in accordance with the purposes of the present invention, as embodied and broadly described herein, the Adjustable Closed-Back Cap of the present invention may include a plurality of panels, including a back panel, each panel having side edges and a bottom edge, the side edges of adjacent panels being attached together to form a cap, with the cap having a front side and a rear side. A fabric tunnel is provided along the bottom edge of the back panel. A flexible strap having a fixed end and a free end is slidably received within the fabric tunnel. The flexible strap is attached at the fixed end to the cap adjacent to the back panel and the free end of the strap includes a portion of a releasable connector. A matching portion of the releasable connector is attached to the cap adjacent to the back panel and on an opposite side of the back panel from the attachment point of the fixed end of the strap to the cap.

Other aspects of the closed-back cap of the present invention involve the fabric tunnel including a piece of fabric folded back and sewn to itself to create the tunnel. The releasable connector may include a hook and loop fastener. The strap may include a fabric outer layer on the free end on an opposite side of the strap from the portion of releasable material to provide a soft surface against the head of the wearer. The cap may include seven panels. The fabric tunnel extends across the entirety of the bottom edge of the back panel. The cap is continuously adjustable in size by selectively varying the relative positions of the releasable connector from a cap size of 6½ to a cap size of 7⅝.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
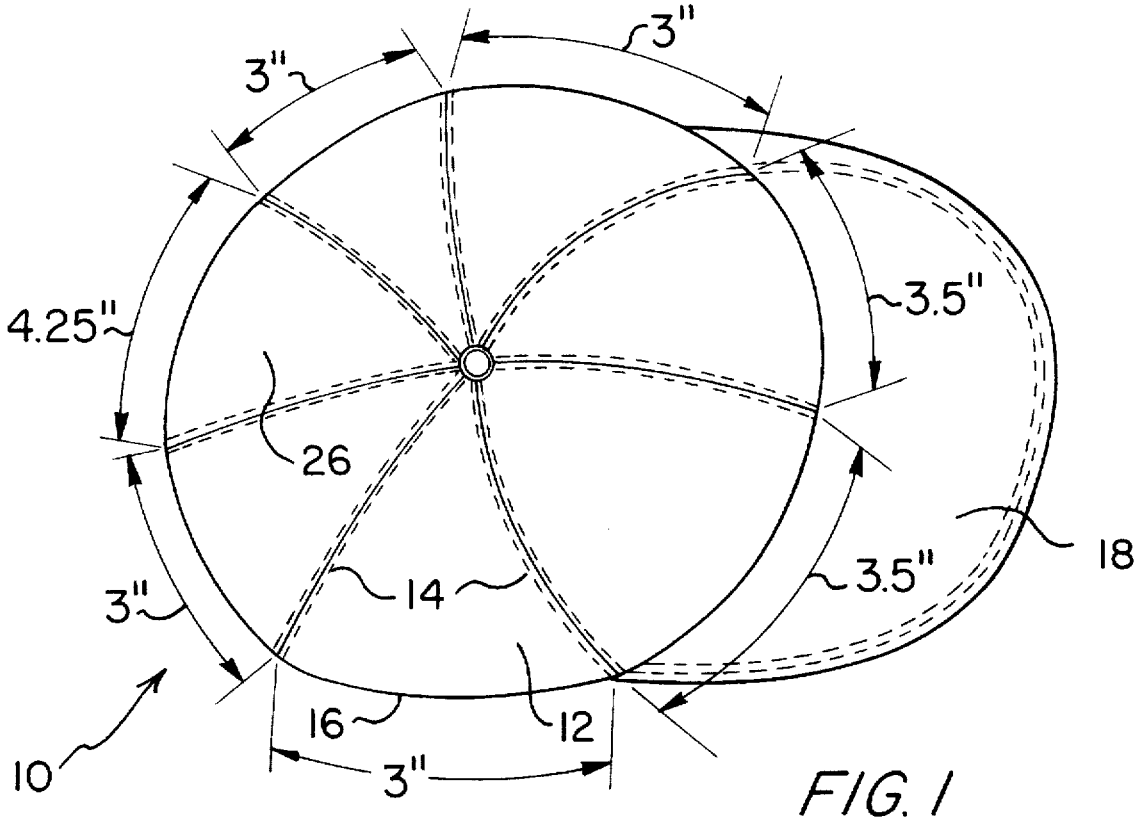
FIG. 1 is an outside top view of a seven panel cap of the present invention with a closed-back.

An adjustable closed-back cap 10 constructed in accordance with the present invention is shown in FIG. 1. The cap 10 includes seven triangularly-shaped panels 12, each having a pair of side edges 14 and a bottom edge 16. Each panel 12 is stitched to its next adjacent panel along one of the side edges 14. The preferred width of each of the panels 12 along the bottom edge 16 thereof is shown in FIG. 1.

Figure 2:
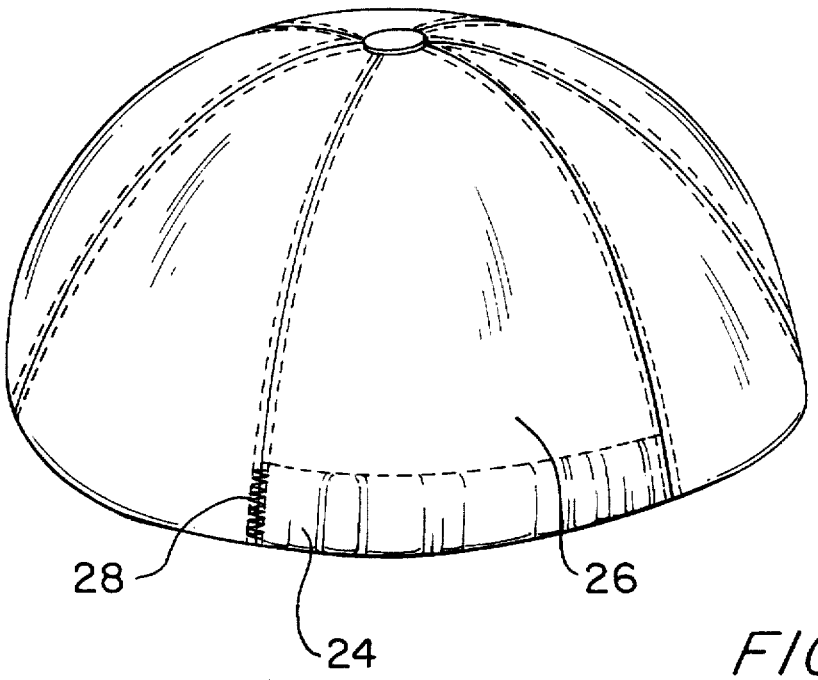
FIG. 2 is an outside rear view of the seven panel cap of FIG. 1 showing the position of the adjustable closure provided by the fabric tunnel.
Figure 4:
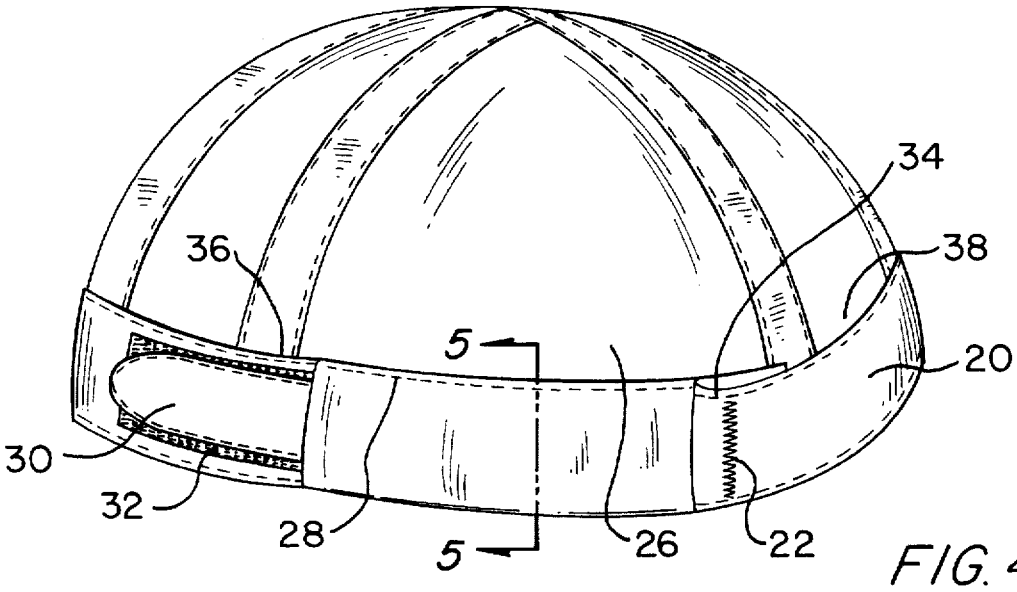
FIG. 4 is an inside view of the cap of FIG. 1 adjusted to fit the largest possible head size of 7⅝.
Figure 5:
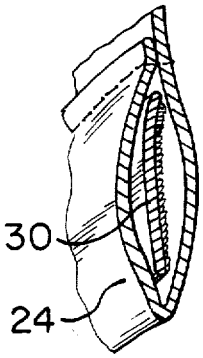
FIG. 5 is a cross-section taken along line 5—5 of FIG. 4, showing the flexible strap slidably received within the fabric tunnel.

A back panel 26 of the cap 10 includes a fabric tunnel 24 created by folding the back panel 26 (toward the inside of the cap) over against itself and providing a sewing stitch 28, as shown in FIG. 2, so as to enclose an elongated area between the folded over portions of the back panel. The tunnel 24 is open at either end thereof, as shown in FIG. 4, to slidably receive a flexible strap 30. A first or fixed end 31 of the strap 30 is affixed to the cap 10 by a bartack sewing stitch 22 made at or near the side edges 14 of the back panel 26 and the adjacent panel 12. A sweatband 20 is provided, as is known, along the bottom edge 16 of each panel 12 for increased comfort to the wearer. Preferably, the strap 30 may be affixed to or be a unitary part of the sweatband 20. Further, the stitch 28 creating the fabric tunnel 24 may be aligned with the top edge 38 of the sweatband 20.

Figure 3:
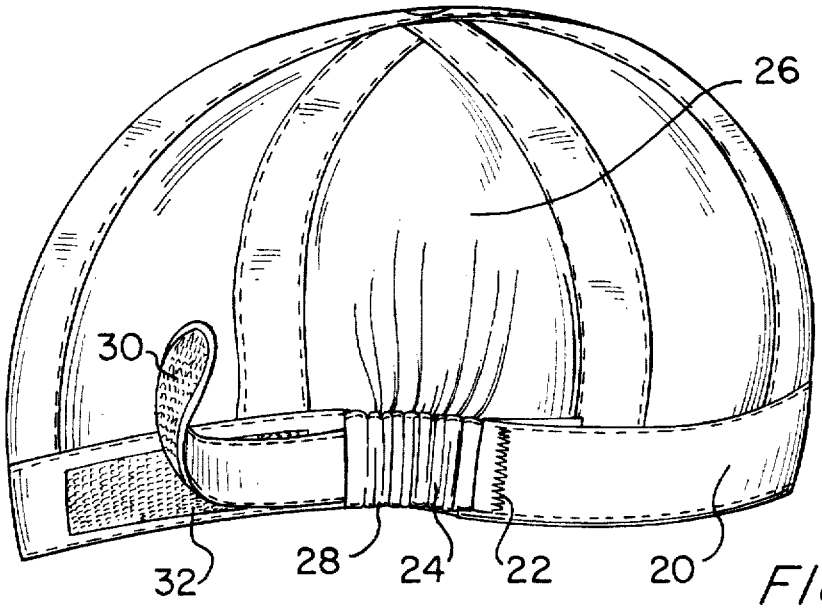
FIG. 3 is an inside view of the cap of FIG. 1 adjusted to fit the smallest possible head size of 6½.

A free end 33 of the strap 30 is provided with a strip of a first component 40 (such as loops) of releasable connector material (hooks and loops), as shown in FIG. 3. Provided on the sweatband 20 in the vicinity of the panel 12 adjacent to and on the opposite side of the back panel 26 from the bartack stitch 22 is a strip of a second component 32 (such as hooks) of releasable connector material. Thus, the strip 40 on the strap 30 can be selectively engaged with the strip 32 on the sweatband 30. By sliding the strap 30 in or out of the fabric tunnel 24, the relative positions of the strips 32 and 40 of the releasable connector material can be varied and thus the effective circumference of the sweatband 20 and fabric tunnel 24 can be varied to change the cap size for different head sizes.

FIG. 3 is a representation of the inside of the cap 10 with the strap 30 adjusted to fit a small size, such as 6½. FIG. 4 is a representation of the inside of the cap 10 with the strap 30 adjusted to fit a large head size, such as 7⅝. The sweatband 20 starts at the seam along the side edge 14 of the back panel 26 from sweatband starting point 34 (FIG. 3) sewing around the front of the cap 10 to sweatband finishing point 36. The strip with the hook fastener 32 is bartacked to the sweatband by point 36 next, followed by bar tack attachment by the stitch 22 of the first end 31 of the fabric strap 30 near sweatband starting point 34. The back panel 26 is then folded up and over the one inch tails of excess sweatband 20 at starting point 34, and finishing point 36, and closed to cream a runnel with sewing stitch 28. Bartack sewing stitches are used for durability purposes to attach the strip of hook fastener 32 and to attach the strap 30 at the fabric strap stitch 22, however many other sewing stitches would be adequate to attach. Fabric strap 30 is pulled through tunnel 24 and the size of the cap 10 is adjusted to the desired head size by attaching the loop fastener on the fabric strap 30 to the hook fastener to create the desired circumference to fit the wearer's head.

The manner of utilizing the adjustable closure of the present invention is similar to all other adjustable closures. The fabric strap 30 with loop fastener 40 is attached to the hook fastener 32 to create the desired circumference to fit each individual head. The cap is then put on the head and any final minimal adjustment can be made to fit more comfortably in the same manner as above. FIG. 3 and FIG. 4 represent the size range adjustment available with CAPSIZE. An adjustment of approximately 3½ inches in circumference is possible thereby allowing CAPSIZE to fit all head sizes within the range of 6½ to 7⅝.

Accordingly, the reader will see that the present invention can be used to create a maximally adjustable closed-back or "fitted" look cap. The present invention provides the only fully adjustable cap (covering sizes 6½ to 7⅝) with a closed-back and "fitted" cap look. As discussed above, this is a desirable feature for retailers and for young wearers, particularly those still in their growing years.

The foregoing description is considered as illustrative only of the principles of the invention. Furthermore, since numerous modifications and changes will readily occur to those skilled in the art, it is not desired to limit the invention to the exact construction and process shown and described above. Accordingly, all suitable modifications and equivalents may be resorted to falling within the scope of the invention as defined by the claims which follow.

The embodiments of the invention in which an exclusive property or privilege is claimed are defined as follows:

1. A closed-back cap, adjustable in size to fit a broad assortment of sizes of wearer's heads, comprising:

a plurality of panels, including a back panel, each panel having side edges and a bottom edge, the side edges of adjacent panels being attached together to form a cap, the cap having a front side and a rear side;

a fabric tunnel provided along the bottom edge of the back panel;

a flexible strap having a fixed end and a free end, the strap being slidably received within the fabric tunnel and attached at the fixed end to the cap adjacent to the back panel, the strap having a portion of a releasable connector provided on the free end thereof; and a matching portion of the releasable connector attached to the cap adjacent to the back panel and on an opposite side of the back panel from the attachment point of the fixed end of the strap to the cap.

2. A cap as defined in claim 1 wherein the fabric tunnel includes a piece of fabric folded back and sewn to itself to create the tunnel.

3. A cap as defined in claim 1 wherein the releasable connector includes a hook and loop fastener.

4. A cap as defined in claim 1 wherein the strap includes a fabric outer layer on the free end on an opposite side of the strap from the portion of releasable material to provide a soft surface against the head of the wearer.

5. A cap as defined in claim 1 wherein the cap includes seven panels.

6. A cap as defined in claim 1 wherein the fabric tunnel extends across the entirety of the bottom edge of the back panel.

7. A cap as defined in claim 1 wherein the cap is continuously adjustable in size by selectively varying the relative positions of the releasable connector from a cap size of 6½ to a cap size of 7⅝.

* * * * *

UNITED STATES PATENT AND TRADEMARK OFFICE

CERTIFICATE OF CORRECTION

PATENT NO. : 5,548,845
DATED : August 27, 1996
INVENTOR(S) : James A. Gallup

It is certified that error appears in the above-indentified patent and that said Letters Patent is hereby corrected as shown below:

In column 1, designated line 18, after the word "by" insert --1/8--.

In column 1, designated line 35, after the word "exact" change "fight" to --right--.

In column 1, designated line 35, after the word "the" change "fight" to --right--.

In column 4, designated line 30, change "cream" to --create--.

In column 4, designated line 30, change "runnel" to --tunnel--.

Signed and Sealed this

Tenth Day of December, 199

*Attest:*

*Attesting Officer*

Bruce Lehman

BRUCE LEHMAN

*Commissioner of Patents and Trademarks*